313-428 SR
6/19/84 XR 4,455,541

United States Patent [19]

Nosaka

[11] 4,455,541

[45] Jun. 19, 1984

[54] COLOR CATHODE RAY TUBE DEVICE

[75] Inventor: Eisho Nosaka, Kyoto, Japan

[73] Assignee: Mitsubishi Denki Kabushiki Kaisha, Tokyo, Japan

[21] Appl. No.: 408,999

[22] Filed: Aug. 17, 1982

[30] Foreign Application Priority Data

Aug. 18, 1981 [JP] Japan ..... 56-129707

[51] Int. Cl.[3] ..... H01F 7/00

[52] U.S. Cl. ..... 335/210; 313/428; 335/213

[58] Field of Search ..... 335/210, 212, 213; 313/421, 426, 428, 431

[56] References Cited

U.S. PATENT DOCUMENTS 4,138,628 2/1979 Smith ..... 335/210 X 4,145,677 3/1979 Maruyama et al. ..... 335/210 X

*Primary Examiner*—George Harris

*Attorney, Agent, or Firm*—Sughrue, Mion, Zinn, Macpeak & Seas

[57] ABSTRACT

A cathode ray tube is improved by disposing a dynamic convergence component at a location so as to minimize the electric power required for convergence correction, with respect to the positions of the deflection yoke and the static convergence component. A coma control component, if provided, is located without the axial width of the dynamic component.

5 Claims, 8 Drawing Figures

COLOR CATHODE RAY TUBE DEVICE

BACKGROUND OF THE INVENTION

The present invention relates to a color cathode ray tube (CRT) device of the in-line type, in which the positional arrangement of a dynamic convergence correcting magnetic field generating component (referred to as a dynamic convergence component, hereinafter) relative to the electron gun is improved.

In conventional color CRT devices of the in-line type, the distribution of the magnetic field generated by a deflection yoke is made suitably non-uniform, and a magnetic field control element incorporated in an end portion of the electron gun together with the suitable non-uniform magnetic field distribution converge these in-line electron beams onto an image surface of the tube. However, possible variations of the magnetic field generated by the deflection yoke, the magnetic field distribution of the in-line arrangement of the three electron beams emitted from the electron gun, of the electron beam and the deflection yoke in combination as well as possible assembly errors in mass-production have caused precise convergence of the three electron beams throughout the surface of the image plane to be impossible. In general, the amount of convergence error to be further corrected in a mass-produced color CRT device of this type is about 0.5–1.0 mm.

Particularly, when a color CRT device of the in-line type is used as a display device of a computer terminal, color deviations around peripheral portions of the image plane cause characters displayed on the CRT image plane in different colors to deviate from each other and thus the quality of the CRT device as a display medium is degraded.

In order to correct this convergence error and hence eliminate the color deviation problem around the periphery of the tube surface, it has been proposed to arrange the dynamic convergence component at the outer periphery of a neck portion of the color CRT. This proposal has been realized in various manners.

FIG. 1 is a schematic illustration of the neck portion of a color CRT device 1 of the in-line type, which is constructed according to a typical example of the above proposal. In FIG. 1, a three beam electron gun 3 for producing three in-line electron beams 31, 32 and 33 is incorporated in the neck portion 2. Various voltages are applied through a base portion 4 to the electron gun 3 to cause the latter to emit the beams 31, 32 and 33. These electron beams are passed through a deflection yoke 5 which produces a specific non-uniform magnetic field distribution and are deflected horizontally and vertically towards given points on the image surface.

A static convergence correction magnetic field generating component (referred to as a static convergence component hereinafter) composed of two, four and six pole magnets is provided around the outer periphery of the electron gun 3, in which the three electron beams 31, 32 and 33 are corrected in convergence error around a central portion of the image plane and converged to a point in the central area by regulating the magnetic field strengths of two four-pole magnets and two six-pole magnets. Color purity correction at the image plane is also performed by regulating the magnetic field strength of the two-pole magnet. The three beams 31, 32 and 33 to be converged to a point in the central area of the image plane pass through the magnetic field produced by the deflection yoke 5 and are deflected horizontally and vertically. It is required that the three beams be convergable at any point whether at peripheral or central areas of the image plane.

In order to realize the above, the magnetic field produced by the deflection yoke 5 should be distributed non-uniformly in a specific horizontal and vertical pattern and a coma correction should be provided. The coma correction is performed by a coma correcting magnetic field control component (referred to as coma control component hereinafter) 7 provided at an end of the electron gun 3 so that a deflection sensitivity correction of the center beam 32 and the side beams 31 and 33 may be performed.

In order to further improve the convergence preciseness of the beams 31, 32 and 33 in the peripheral areas of the image plane, the side beams 31 and 33 are corrected by the dynamic convergence component 8 provided between the deflection yoke 5 and the static convergence component 6 so that these beams 31 and 33 are overlapped on the central beam 32. Therefore, the amount of convergence to be corrected can be reduced to an amount smaller than 0.5 mm.

The dynamic convergence component 8 is composed of two four-pole magnetic field generating elements 81 and two six-pole magnetic field generating elements 32 as shown in FIGS. 2A and 2B, respectively. The elements 81 are composed of a ferrite core ring 83 and two sets of four coils 85 wound equiangularly on the ring 83, the sets of coils 85 being off-set in phase by 45° from each other as shown in FIG. 2A, and the elements 32 are composed of a similar ferrite core ring 84 and two sets of six coils 86 wound equiangularly on the ring 84, the sets of the coils 86 being off-set in phase by 30° from each other. It should be noted that the core ring 84 may be eliminated and instead, the core ring 83 may be used concurrently. The convergence correction is performed by varying the magnetic field strengths produced thereby by regulating the currents flowing through the coils 85 and coils 86, respectively.

However, the correction sensitivity of the element 82 of the dynamic convergence component 8 is very low and therefore a large amount of current must be supplied to the coils 85 causing the correction cost to be very high. Furthermore, the heat generated in the coils 86 due to the large amount of current flowing therethrough causes a drift in the dynamic convergence correction.

SUMMARY OF THE INVENTION

An object of the present invention is to provide a color cathode ray tube device of the in-line type in which the arrangement of the dynamic convergence component with respect to the electron gun is optimized to improve the correction sensitivity of the component to thereby minimize the electric power required to realize the correction.

Figure 3:
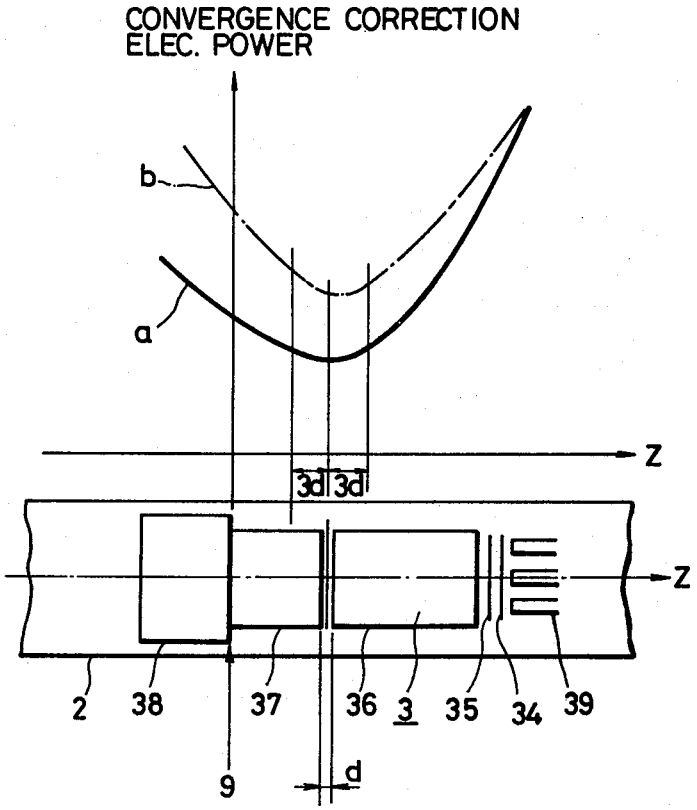
Figure 4:
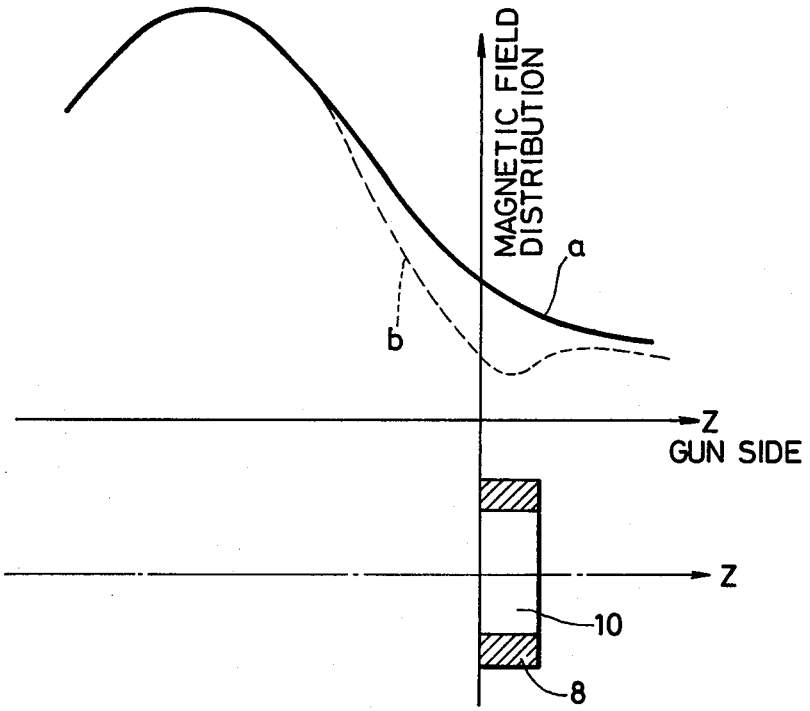
Figure 5:
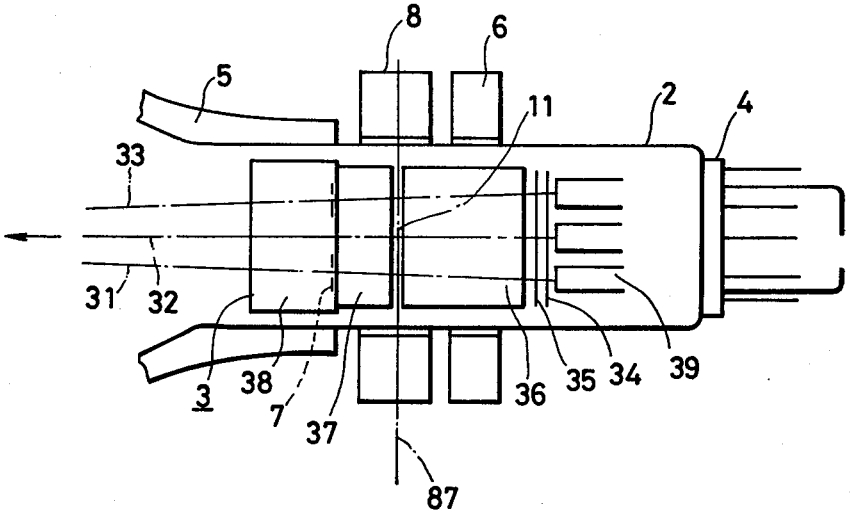

FIGS. $2A_1$, $2A_2$, $2B_1$ and $2B_2$ illustrate the dynamic convergence component;

FIG. 3 is a graph showing the relation between the setting position of the dynamic convergence component and the electric power for convergence correction;

FIG. 4 illustrates the magnetic field distribution when the dynamic convergence component is disposed within a magnetic field produced in the deflection yoke; and FIG. 5 is a schematic illustration of the neck portion of an example of the color CRT device according to the present invention.

DETAILED DESCRIPTION OF THE PREFERRED EMBODIMENTS

In FIG. 3, the relation between the position of the six-pole field generating element 82 of the dynamic convergence component 8 relative to the electron gun 3 and the electric power for convergence correction is shown. The electron gun 3, which is of the general bipotential type, is composed of three in-line cathodes 39, a first grid 34, a second grid 35, a third grid electrode 36, a fourth grid electrode 37 and a shield cup electrode 38. It should be noted that the so-called multi-stage convergence type electron gun which has been widely used recently is basically similar to the gun shown in FIG. 3. That is, the only difference between the guns is that a single prefocussing lens is provided in front of a main electric lens located between the third and fourth electrodes 36 and 37 in the bipotential type gun, while a plurality of various prefocussing lenses are arranged in the multi stage type gun. In this connection, the character Z in FIG. 3 depicts the axis of the tube.

Figure 1:
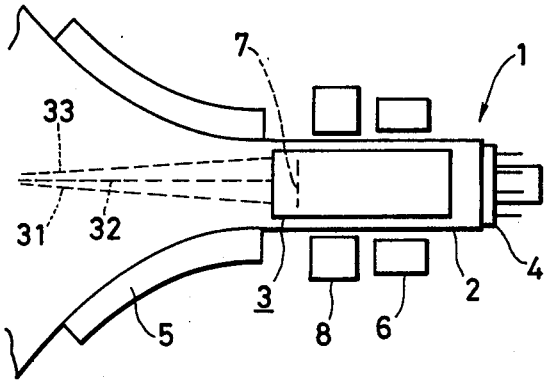
FIG. 1 is a schematic illustration of the neck portion of a conventional color CRT device.
Figure 2:
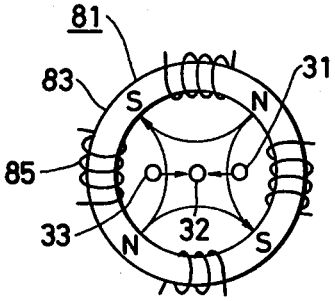
Figure 2:
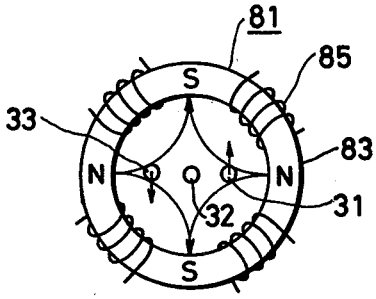
Figure 2:
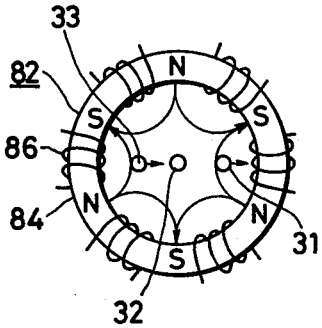
Figure 2:
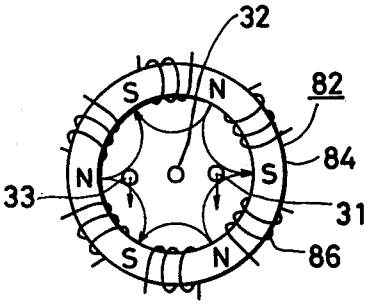

Generally, the coma control component 7 (FIG. 1) is provided in a border portion 9 between the fourth electrode 37 and the shield cup electrode 38. In FIG. 3, a curve a shows the variation of the electric power required for convergence when no coma control component 7 is provided. As shown in FIG. 3, the electric power required for the dynamic convergence component 8 becomes a minimum around the main lens of the gun 3 regardless of the presence of the coma control component 7. When the component 7 is provided, while the position at which the electric power for effecting correction is minimum is unchanged, the minimum value is increased. The minimum value of the power for correction depends upon the size of the component 7 as well as the relative distance from the component 8 to the component 7.

FIG. 4 shows the vertical component distribution of the deflection field in which curve a shows the field distribution when there is no dynamic convergence component 8 within the deflection field and curve b shows that when the dynamic convergence component 8 is provided within the deflection field. As is clear from FIG. 4, when the component 8 is provided, the vertical field strength on the gun side is remarkably reduced. In this connection, it should be noted that the variation in the horizontal field distribution is slightly affected by the presence of the component 8. The reason for this is that a ferrite core ring is used as the dynamic convergence component 8 on which the coils are wound to produce the four-pole magnetic fields and six-pole magnetic fields, and the gun side component of the vertical magnetic field is shunted by the ring core. Therefore, when the dynamic convergence correction element 8 is provided, the size and configuration of the component 7 should be increased for magnetic field control as compared with the case when the component 8 is not used. Consequently, the electric power required by the dynamic convergence component 8 is undesirably increased. In order to resolve this problem, it is necessary to separate the coma control component 7 from the dynamic convergence component 8. That is, as shown in FIG. 4, the component 7 should be arranged outside the dynamic convergence component 8.

FIG. 5 shows an example of the arrangement of the dynamic convergence component 8, according to the present invention. That is, the dynamic convergence component 8 producing the four- and six-pole magnetic fields is disposed on the outer periphery of the neck portion 2 and between the deflection yoke 5 and the static convergence component 6. The dynamic convergence component 8 is disposed in the main lens portion exhibiting the minimum power for correction, with respect to FIG. 3, i.e., in the electron lens portion composed of the third and fourth electrodes 36 and 37, and the coma control component 7 is disposed in a plane orthogonal to the axis Z and is positioned in the side of the yoke 5 outside of a region 10 (FIG. 4) defined by the dynamic convergence component 8. Therefore, it is possible to improve the correction sensitivity of the dynamic convergence component 8 and reduce the power for correction without undesirably increasing the size of the coma control component 7.

In the above described embodiment, the dynamic convergence component 8 is set exactly at the point where the power for correction becomes a minimum. Therefore, it is necessary to set the center line 87 (FIG. 5) of the component 8 exactly on the center line of a main electron lens gap 11 between the fourth electrode 37 disposed closest to the image surface and the third electrode 36 facing the fourth electrode. However, the center line 87 of the dynamic convergence element 8 may be set within a range of 3d about the center line of the gap 11, where d is the width of the gap 11 between the electrodes 36 and 37, which may be, for example, 1 mm.

Further, although in the above embodiment, an electron gun 3 of the bipotential type is described, the invention is likewise applicable with other multi stage converging type guns. That is, in a multi-stage converging gun, the electron beams emitted by the cathode 39 are converged by successive electric lenses, and therefore, the last electric lens may be considered as the "main" electric lens referred to above.

As mentioned hereinbefore, according to the present invention, the arrangement of the dynamic convergence component with respect to the electron gun is optimized, so that the correction sensitivity of the dynamic convergence component is improved and the electric power for convergence correction is reduced.

What is claimed is:

1. A color cathode ray tube device of the in-line type, comprising; a deflection yoke, a static convergence component and a dynamic convergence component, said dynamic convergence component being disposed with a center plane of a main electron gap, which is orthogonal to an axis of the cathode ray tube, and said plane being within a range of 3d along said axis on either side of a center point defined by the center of a main electron lens gap d located in a region between said deflection yoke and said static convergence component.

2. A color cathode ray tube device as claimed in claim 1, further comprising a coma control component disposed outside of the axial width of said dynamic convergence component.

3. A color cathode ray tube device as claimed in claims 1 or 2, wherein said dynamic convergence component comprises a ring core and a plurality of solenoids wound thereon, said solenoids being adapted to produce four-pole correcting fields and six-pole correcting fields, respectively.

4. A color cathode ray tube device as claimed in claim 1, said dynamic convergence component being disposed within said range at a location minimizing an amount of electric power required for convergence correction.

5. A color cathode ray tube device as claimed in claim 1, said gap d being located between a rear surface of a final electrode of said tube device and a front surface of the next preceeding electrode.

* * * * *